US005119997A

United States Patent [19]

Lee

[11] Patent Number: 5,119,997

[45] Date of Patent: Jun. 9, 1992

[54] TUBULAR BOBBIN AND SPINDLE ASSEMBLY FOR A YARN

[76] Inventor: Jung W. Lee, 7305 Foxe Pl., Springfield, Va. 22151

[21] Appl. No.: 746,619

[22] Filed: Aug. 19, 1991

[51] Int. Cl.[5] ..... B65H 54/54

[52] U.S. Cl. ..... 242/46.21; 242/46.6; 242/46.7

[58] Field of Search ..... 242/46.6, 46.7, 46.8, 242/46.2, 46.21, 46.3, 46.4, 46.5, 129.5, 129.7, 129.71, 130; 57/129, 130

[56] References Cited

U.S. PATENT DOCUMENTS

| | | | |
|---|---|---|---|
| 44,016 | 8/1864 | Reynolds | 242/46.21 |
| 416,292 | 12/1889 | Fowler | 242/46.7 |
| 447,800 | 3/1891 | Walker . | |
| 455,857 | 7/1891 | Murdock et al. | 242/46.8 |
| 686,446 | 11/1901 | Draper | 242/46.7 |
| 924,891 | 6/1909 | Curfew et al. | 242/46.7 |
| 2,236,178 | 3/1941 | Kennedy | 242/46.21 |
| 2,236,179 | 3/1941 | Kennedy | 242/46.21 |
| 2,464,024 | 3/1949 | Carter et al. | 242/46.2 |
| 3,055,609 | 9/1962 | Courtney . | |
| 3,122,877 | 3/1964 | Keyser | 242/46.8 X |
| 4,039,159 | 8/1977 | Champagne | 242/130.1 |
| 4,205,423 | 6/1980 | Poole et al. | 29/402.11 |
| 4,384,685 | 5/1983 | Pitts | 242/46.21 |

FOREIGN PATENT DOCUMENTS

| | | | |
|---|---|---|---|
| 1126785 | 3/1962 | Fed. Rep. of Germany | 57/130 |
| 212560 | 3/1941 | Switzerland | 242/46.3 |
| 23874 | of 1892 | United Kingdom | 242/46.21 |
| 22510 | of 1903 | United Kingdom | 242/46.21 |

*Primary Examiner*—Stanley N. Gilreath
*Attorney, Agent, or Firm*—Birch, Stewart, Kolasch & Birch

[57] ABSTRACT

A bobbin and spindle assembly comprises a tubular bobbin, an annular slotted rubber ring, a rubber ring, and a spindle supported on a basic body and having an annular recess disposed on the basic body and an annular slot disposed on the upper portion thereof for being slidably assembled with the tubular bobbin.

4 Claims, 2 Drawing Sheets

FIG. 1
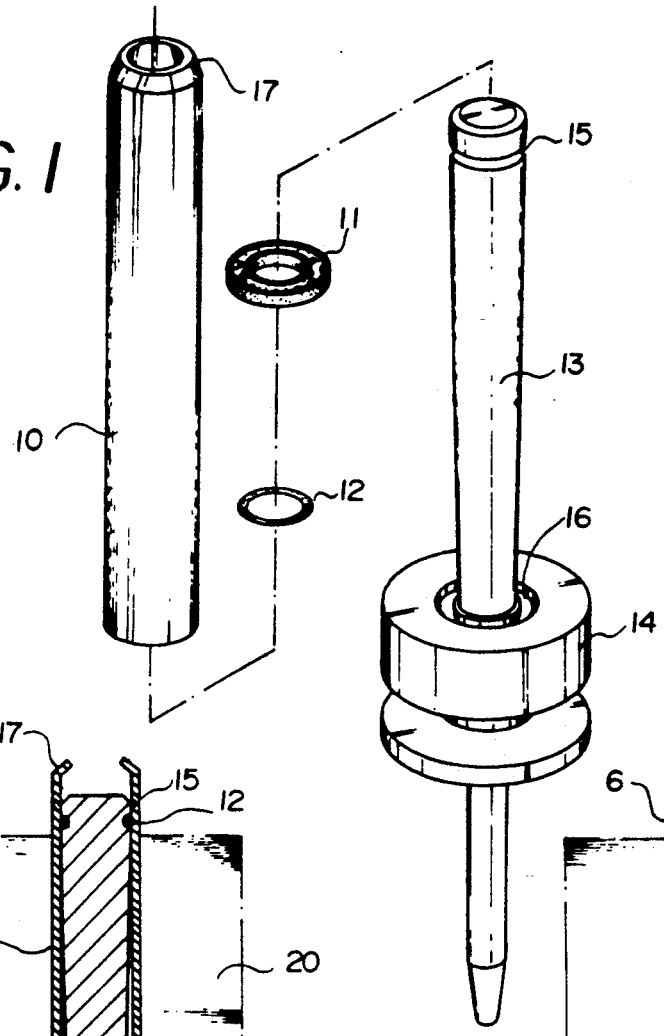
FIG. 2
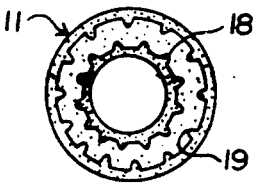
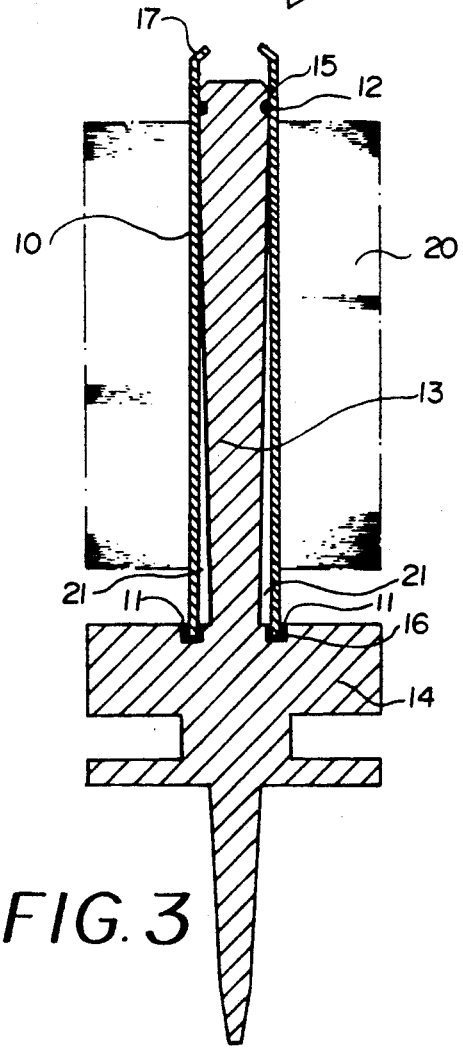
FIG. 3
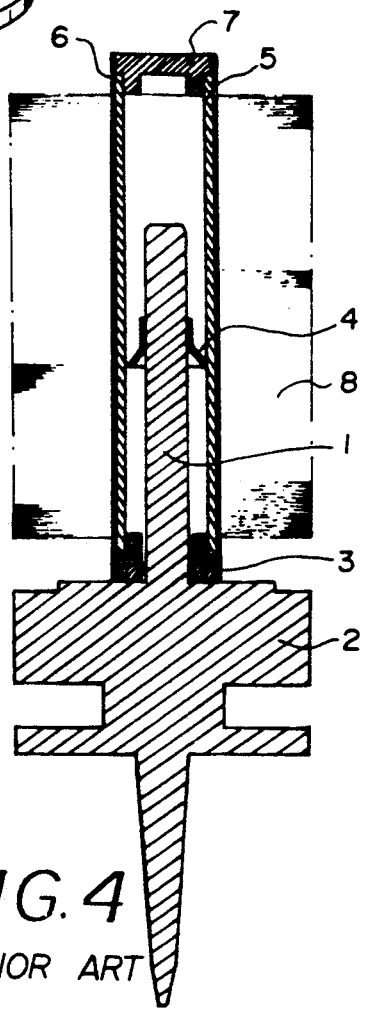
FIG. 4
PRIOR ART

TUBULAR BOBBIN AND SPINDLE ASSEMBLY FOR A YARN

BACKGROUND OF THE INVENTION

1. Field of the Invention

The present invention relates to a tubular bobbin assembled with a spindle for a yarn and more particularly, to an improved bobbin and spindle assembly employed for spinning, twisting, winding, etc., of yarns.

2. Description of the Prior Art

Various types of bobbin and spindle assemblies are well known in the textile industry. As shown in FIG. 4, such prior art discloses a spindle 1 supported on a basic body 2 and having an adaptor 3 and a support 4 for tightly assembling with a bobbin 5 which is covered by a cover 6 and a cap 7 to be wound and spun with the yarn 8. However, such prior art suffers from a number of problems such as, for example, (a) it is very complicated in construction and expensive to manufacture; (b) it cannot obtain a high mechanical accuracy; and (c) it is difficult and time consuming to assemble or disassemble.

SUMMARY OF THE INVENTION

Accordingly, it is an object of the present invention to provide a tubular bobbin assembled with a spindle for a yarn which eliminates the above problems encountered in a conventional bobbin and spindle assembly.

Another object of the present invention is to provide a bobbin and spindle assembly employed for spinning, twisting, and winding of yarn, which includes a tubular bobbin and a spindle having a basic body, and an annular recess disposed thereon for tightly receiving a slotted rubber ring that receives the bottom of the tubular bobbin and an annular slot disposed on the upper portion thereof for tightly receiving a rubber ring that slidably attaches to the inner surface of the tubular bobbin, whereby the tubular bobbin is assembled with the spindle.

A further object of the present invention is to provide an assembly of a tubular bobbin and spindle for yarn, which is simple in construction, compact for portability, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a bobbin and spindle assembly which comprises a tubular bobbin, an annular slotted rubber ring, an annular rubber ring, and a spindle supported on a basic body and having an annular recess disposed on the top portion of the basic body and an annular slot disposed on the upper portion thereof for being slidably assembled with the tubular bobbin.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is an exploded perspective view of the bobbin and spindle assembly for yarn according to the present invention;

FIG. 2 is a top plan view of an annular slotted rubber ring according to the present invention;

FIG. 3 is a sectional view of the assembled bobbin and spindle according to the present invention;

FIG. 4 is a sectional view of the conventional bobbin and spindle assembly.

DESCRIPTION OF THE PREFERRED EMBODIMENTS

Figure 5:
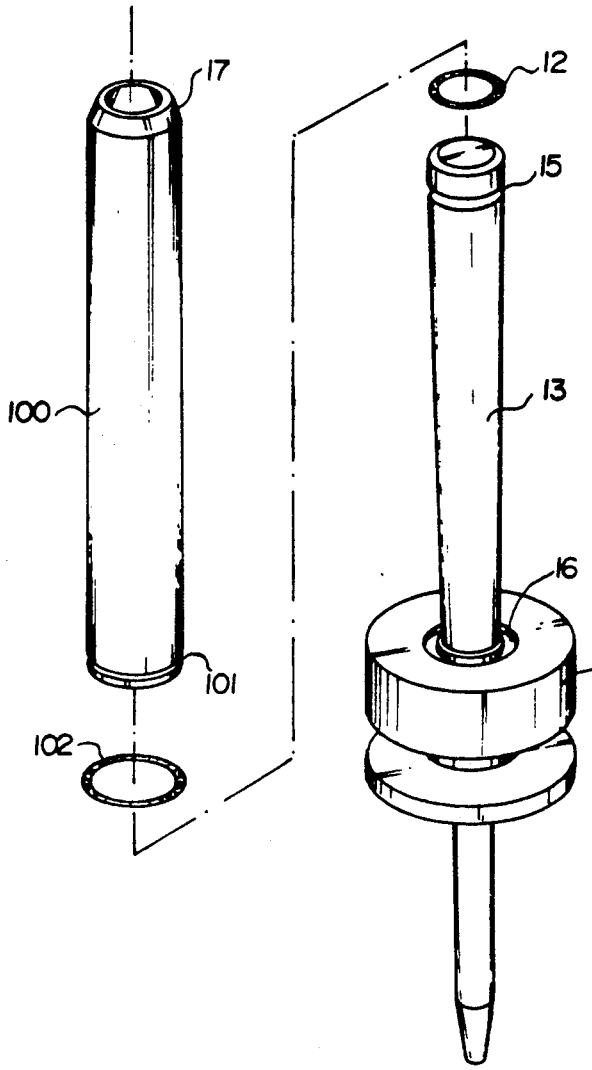
FIG. 5 is an exploded perspective view of another embodiment of the combined bobbin and spindle assembly according to the present invention.

Referring now in detail to the drawings for the purpose of illustrating preferred embodiments of the present invention, the bobbin and spindle assembly as shown in FIGS. 1, 2, and 3, comprises a tubular bobbin 10, an annular slotted rubber ring 11, a rubber ring 12, and a spindle 13 having a basic body 14 for being slidably assembled with the tubular bobbin 10.

The spindle 13 has a downwardly tapered configuration which is gradually reduced from the top to bottom and includes an annular slot 15 disposed on the upper end portion thereof and an annular recess 16 disposed on the top portion of the supporting basic body 14.

The tubular bobbin 10 has an inwardly tapered end portion 17 for being easily released from the spindle 13 after the tubular bobbin 10 is assembled with the spindle 13. When the wound yarns 20 compress against the outer surface of the tubular bobbin 10, an annular space 21 between the bobbin 10 and spindle 13 is maintained.

The slotted ring 11 includes an annular recess 18 and a plurality of rubber spikes 19 extending from the interior thereof, whereby the slotted rubber ring 11 is tightly inserted into the annular recess 16 (FIGS. 2 and 3).

The bobbin and spindle assembly according to the present invention assembles as follows:

First of all, the slotted rubber ring 11 is tightly inserted into the annular recess 16 and the rubber ring 12 is tightly inserted into the annular slot 15 of the spindle 13. Thereafter, the tubular bobbin 10 is slid onto the spindle 13. The annular space 21 is formed between the inner surface of the tubular bobbin 10 and the outer surface of the spindle 13 (FIG. 3). The bottom end of the tubular bobbin 10 is inserted into and firmly fixed to the annular recess 18 and simultaneously the upper portion of the inner surface of the tubular bobbin 10 is pressed against by the rubber ring 12 so that the tubular bobbin 10 is tightly assembled with the spindle 13 (FIG. 3).

After the assembled bobbin 10 is wound with yarns 20 and is needed to be separated from the spindle 13, the hand or a conventional pulling device is utilized to pull the tapered end portion 17. In addition, the annular space 21 between the tubular bobbin 10 and the spindle 13 facilitates the disassembling of the bobbin 10 from the spindle 13.

Figure 6:
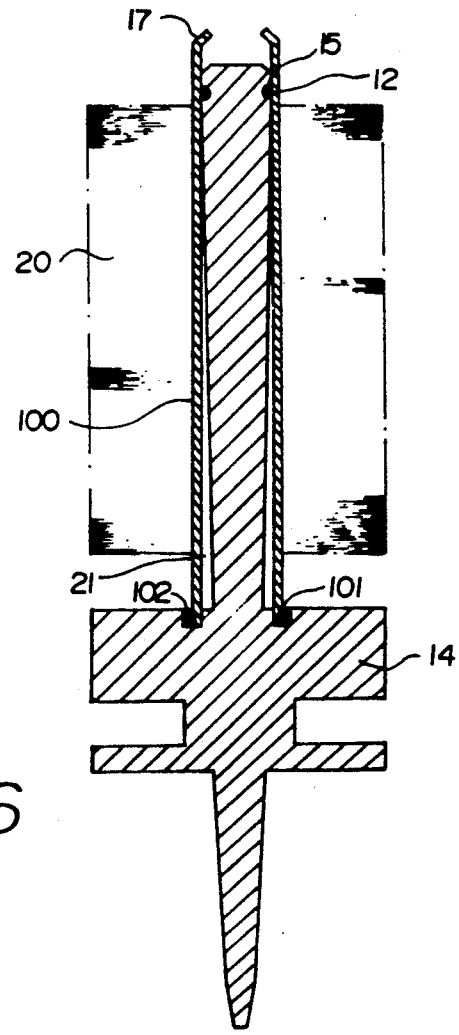
FIG. 6 is a sectional view of the assembled bobbin and spindle according to the present invention.

Referring in detail to FIGS. 5 and 6, there is illustrated an additional embodiment of a bobbin and spindle assembly in accordance with the present invention.

The bobbin and spindle assembly comprises a tubular bobbin 100 having the tapered end portion 17 disposed at the top and a annular bobbin slot 101 for tightly receiving a bobbin rubber ring 102 and the spindle 13 having the annular slot 15, the rubber ring 12, and the annular recess 16 same as those of the original embodiment of the present invention.

As shown in FIG. 6, when the tubular bobbin 100 attached with the bobbin rubber ring 102 is tightly fixed to the spindle 13 attached with the rubber ring 12, the bobbin rubber ring 102 of the bottom end portion of the tubular bobbin 100 is completely inserted into the annular recess 16 and simultaneously, the attached rubber ring 12 presses against the inner surface of the tubular bobbin 100.

Accordingly, the bobbin and spindle assembly according to the present invention is very simple in construction, inexpensive to manufacture, durable in use, and refined in appearance.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A bobbin and spindle assembly for yarns comprises:

a tubular bobbin having one inwardly tapered end, a slotted rubber ring, a rubber ring, and a spindle assembled with said tubular bobbin, said spindle projecting vertically and including:

a basic body disposed on a lower portion of said spindle, an annular slot disposed on an upper portion of said spindle for tightly fixing said rubber ring, and an annular recess disposed on a tope portion of said basic body for tightly fitting with said slotted rubber ring, whereby the tubular bobbin is vertically positioned in the slotted rubber ring on the basic body with the tapered end of the tubular bobbin facing upwardly and the rubber ring on the spindle tightly fixing the tubular bobbin to the spindle.

2. The bobbin and spindle assembly for yarns of claim 1, wherein said spindle has downwardly tapered configuration for forming an annular space with the tubular bobbin so as to easily release the tubular bobbin from the spindle.

3. The bobbin and spindle assembly for yarns of claim 1, wherein said slotted rubber ring includes an annular recess and a plurality of rubber spikes for tightly packing with the tubular bobbin.

4. A bobbin and spindle assembly for yarns which comprises:

a tubular bobbin having one inwardly tapered end and the other end having annular slot, a first large rubber ring tightly fitted into said annular slot, a second small rubber ring, and a spindle assembled with said tubular bobbin, said spindle projecting vertically and including:

a basic body on a lower portion of said spindle, an annular slot disposed on an upper portion of the spindle for tightly fixing said second small rubber ring, and an annular recess disposed on a top portion of said basic body for tightly fitting with said first large rubber ring, whereby the tubular bobbin is vertically positioned with said first large rubber ring on the bobbin positioned in said annular recess disposed on the top portion of said basic body with the tapered end of the tubular bobbin facing upwardly and the rubber ring on the spindle tightly fixing the tubular bobbin to the spindle.

* * * * * .